US009804534B2

(12) United States Patent
Tsuda et al.

(10) Patent No.: US 9,804,534 B2
(45) Date of Patent: Oct. 31, 2017

(54) IMAGE FORMING APPARATUS

(71) Applicant: FUJI XEROX CO., LTD., Tokyo (JP)

(72) Inventors: Yu Tsuda, Kanagawa (JP); Yasunori Unagida, Kanagawa (JP); Kanji Watanabe, Kanagawa (JP); Yuji Kikuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/207,563

(22) Filed: Jul. 12, 2016

(65) Prior Publication Data

US 2017/0199483 A1 Jul. 13, 2017

(30) Foreign Application Priority Data

Jan. 12, 2016 (JP) ..... 2016-003742

(51) Int. Cl.
*G03G 15/16* (2006.01)

(52) U.S. Cl.
CPC ... *G03G 15/16* (2013.01); *G03G 2215/00455* (2013.01)

(58) Field of Classification Search
CPC ..... G03G 15/16; G03G 2215/0158
See application file for complete search history.

(56) References Cited

U.S. PATENT DOCUMENTS 7,174,125 B2 * 2/2007 Yamasaki ..... G03G 15/5062 101/185
2010/0111564 A1 * 5/2010 Yamashita ..... G03G 15/0813 399/159

FOREIGN PATENT DOCUMENTS

JP 2011-64715 A 3/2011

* cited by examiner

*Primary Examiner* — Erika J Villaluna
(74) *Attorney, Agent, or Firm* — Sughrue Mion, PLLC

(57) ABSTRACT

An image forming apparatus includes a photosensitive member that includes a photosensitive layer, the photosensitive layer being thicker at a first axial end of the photosensitive member than at a second axial end of the photosensitive member; and a forming unit that forms a first image and a second image on the photosensitive member, the first image being transferred to each of transfer areas defined on continuous-form paper, the second image being transferred to the first axial end but to neither a position between adjacent ones of the transfer areas that are side by side in a longitudinal direction of the continuous-form paper nor a position in any of the transfer areas.

7 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2016-003742 filed Jan. 12, 2016.

BACKGROUND

Technical Field

The present invention relates to an image forming apparatus.

SUMMARY

According to an aspect of the invention, there is provided an image forming apparatus including a photosensitive member that includes a photosensitive layer, the photosensitive layer being thicker at a first axial end of the photosensitive member than at a second axial end of the photosensitive member; and a forming unit that forms a first image and a second image on the photosensitive member, the first image being transferred to each of transfer areas defined on continuous-form paper, the second image being transferred to the first axial end but to neither a position between adjacent ones of the transfer areas that are side by side in a longitudinal direction of the continuous-form paper nor a position in any of the transfer areas.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will now be described with reference to the accompanying drawings, wherein an arrow H represents the vertical direction, and an arrow W represents the horizontal direction corresponding to the widthwise direction of the apparatus (hereinafter referred to as "the apparatus-width direction").

Configuration of Image Forming Apparatus 10

Figure 1:
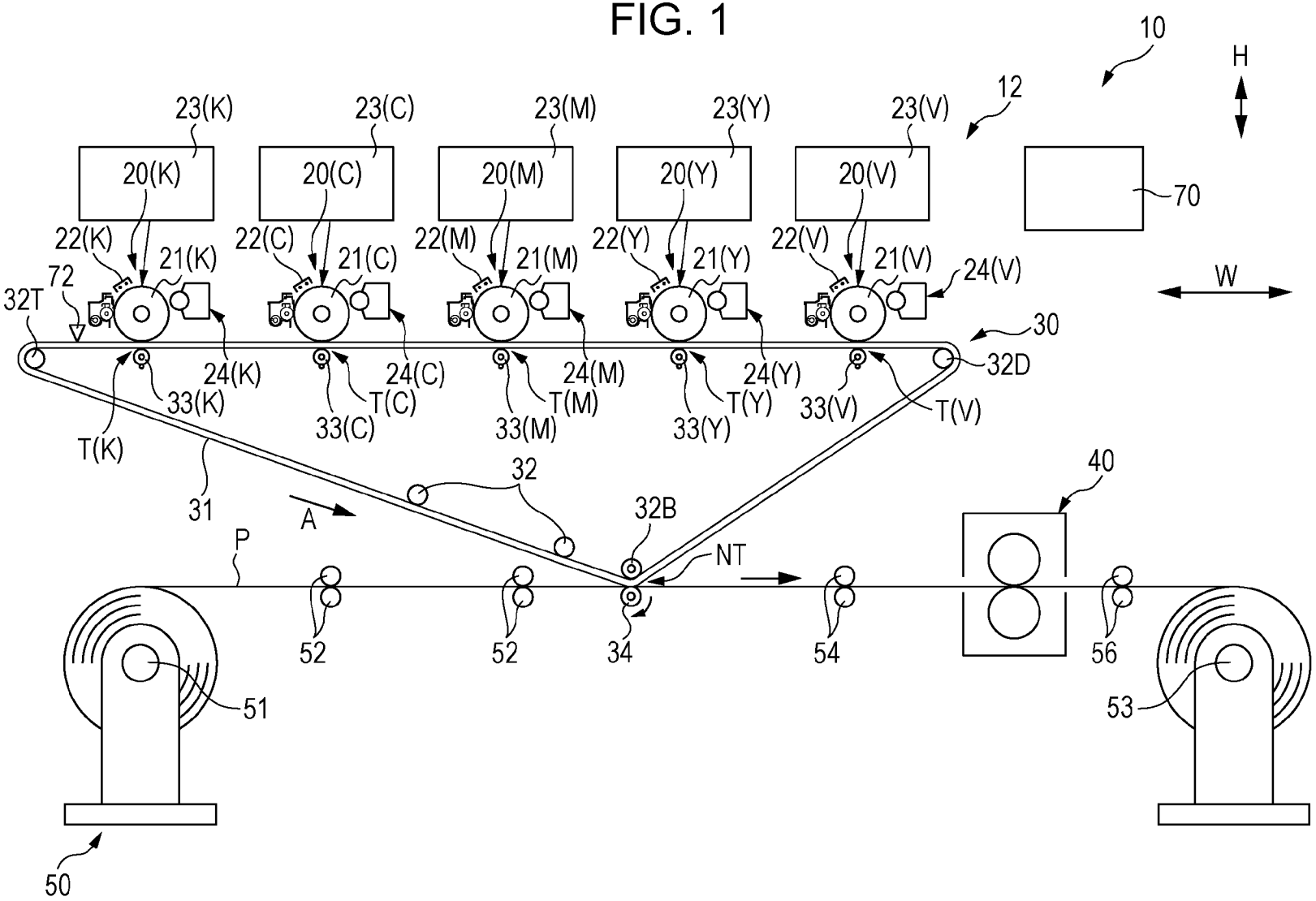
FIG. 1 is a schematic diagram illustrating a configuration of an image forming apparatus, seen from the front side, according to the exemplary embodiment.

FIG. 1 is a schematic diagram illustrating a configuration of an image forming apparatus 10, seen from the front side, according to the exemplary embodiment. As illustrated in FIG. 1, the image forming apparatus 10 includes an image forming section 12 that electrophotographically forms an image on continuous-form paper P such as a label sheet, a transporting device 50 that transports the continuous-form paper P, and a controller 70 that controls operations of relevant elements included in the image forming apparatus 10.

Transporting Device 50

As illustrated in FIG. 1, the transporting device 50 includes a feed roller 51 from which a roll of continuous-form paper P is unwound, a winding roller 53 on which the unwound continuous-form paper P is wound, and pairs of transport rollers 52, 54, and 56 that transport the continuous-form paper P. The winding roller 53 is rotated by a driving unit (not illustrated). Thus, the winding roller 53 winds up the continuous-form paper P while the feed roller 51 unwinds the continuous-form paper P.

The pairs of transport rollers 52 transport the continuous-form paper P from the feed roller 51 to a second-transfer position NT. The pair of transport rollers 54 transport the continuous-form paper P from the second-transfer position NT to a fixing device 40. The pair of transport rollers 56 transport the continuous-form paper P from the fixing device 40 to the winding roller 53.

Image Forming Section 12

The image forming section 12 includes toner-image-forming units 20 that form respective toner images, a transfer device 30 that transfers the toner images formed by the toner-image-forming units 20 to the continuous-form paper P, and the fixing device 40 that fixes the toner images on the continuous-form paper P by applying heat and pressure thereto.

The toner-image-forming units 20 form toner images in different colors. In the present exemplary embodiment, five toner-image-forming units 20 are provided for five colors of yellow (Y), magenta (M), cyan (C), black (K), and a special color (V). The toner-image-forming units 20 are arranged side by side in order of that for the special color (V), that for yellow (Y), that for magenta (M), that for cyan (C), and that for black (K) from the upstream side toward the downstream side in the direction of rotation of a transfer belt 31, which will be described later.

Suffixes (V), (Y), (M), (C), and (K) given to some reference numerals in FIG. 1 indicate the respective colors for which elements denoted by those reference numerals are provided. The special color (V) is, for example, silver or gold.

Toner-Image-Forming Unit 20

The toner-image-forming units 20 basically have the same configuration, except the kinds of toner to be used. Specifically, referring to FIG. 2, the toner-image-forming units 20 each include a photoconductor drum 21 (an exemplary photosensitive member) that rotates clockwise in FIG. 2, a charger 22 that charges the photoconductor drum 21, an exposure device 23 that exposes the photoconductor drum 21 charged by the charger 22 to light and thus forms an electrostatic latent image on the photoconductor drum 21, a developing device 24 that develops the electrostatic latent image formed on the photoconductor drum 21 by the exposure device 23 and thus forms a toner image, and a blade 25 as a removal member that removes residual toner particles from the surface of the photoconductor drum 21 having undergone the transfer of the toner image to the transfer device 30.

The charger 22 charges the surface (a photosensitive layer) of the photoconductor drum 21 to have, for example, negative polarity. The negatively charged surface of the photoconductor drum 21 is exposed to exposure light L emitted from the exposure device 23. The exposed part of the photoconductor drum 21 comes to have positive polarity, whereby an electrostatic latent image is formed on the surface of the photoconductor drum 21. Toner in the developing device 24 is triboelectrically charged to have negative polarity. The negatively charged toner is attracted to the positively charged electrostatic latent image, whereby the electrostatic latent image is developed. In this manner, a toner image is formed on the surface (the outer peripheral surface) of the photoconductor drum 21. Thus, in the present exemplary embodiment, a combination of the charger 22, the exposure device 23, and the developing device 24 serves as an exemplary forming unit that forms a toner image on the photoconductor drum 21. The blade 25 is in contact with the surface of the photoconductor drum 21 and thus scrapes residual toner particles off the surface of the photoconductor drum 21.

Transfer Device 30

The transfer device 30 transfers, in first transfer, the toner images formed on the respective photoconductor drums 21 to the transfer belt 31 (an intermediate transfer body) such that the toner images are superposed one on top of another, and further transfers, in second transfer, the set of toner images superposed on the transfer belt 31 to the continuous-form paper P at the second-transfer position NT (an exemplary transfer nip). Specifically, as illustrated in FIG. 1, the transfer device 30 includes the transfer belt 31, first-transfer rollers 33, and a second-transfer roller 34.

Transfer Belt 31

Referring to FIG. 1, the transfer belt 31 has an endless shape and is positioned by being stretched around plural rollers 32. In the present exemplary embodiment, the transfer belt 31 has an inverted obtuse-triangular shape in front view with the base thereof extending in the apparatus-width direction. Among the plural rollers 32 illustrated in FIG. 1, the roller 32D serves as a driving roller that is driven by a motor (not illustrated) and thus rotates the transfer belt 31 in a direction indicated by an arrow A. The transfer belt 31 transports the toner images transferred thereto in the first transfer to the second-transfer position NT by rotating in the direction of the arrow A.

Among the plural rollers 32 illustrated in FIG. 1, the roller 32T serves as a tension-applying roller that applies tension to the transfer belt 31. Among the plural rollers 32 illustrated in FIG. 1, the roller 32B serves as a counter roller for the second-transfer roller 34. The counter roller 32B is provided at the obtuse vertex, i.e., the lower end, of the transfer belt 31 having the inverted obtuse-triangular shape. The transfer belt 31 is in contact with the photoconductor drums 21 for the respective colors from below at the base, i.e., the upper side, extending in the apparatus-width direction.

First-Transfer Rollers 33

The first-transfer rollers 33 are rollers that transfer the toner images on the respective photoconductor drums 21 to the transfer belt 31. As illustrated in FIG. 1, the first-transfer rollers 33 are provided on the inner side of the transfer belt 31 and across the transfer belt 31 from the respective photoconductor drums 21. A first-transfer voltage of the polarity opposite to the polarity of the toner is applied to each of the first-transfer rollers 33 from a power-feeding unit 37 (see FIG. 2). With the application of the first-transfer voltage, the toner images on the respective photoconductor drums 21 are transferred to the transfer belt 31 at respective first-transfer positions T each defined between a corresponding one of the photoconductor drums 21 and a corresponding one of the first-transfer rollers 33.

Second-Transfer Roller 34

The second-transfer roller 34 transfers the toner images superposed on the transfer belt 31 to the continuous-form paper P. As illustrated in FIG. 1, the second-transfer roller 34 is provided such that the transfer belt 31 is held between the second-transfer roller 34 and the counter roller 32B. The second-transfer roller 34 and the transfer belt 31 are in contact with each other under a predetermined load. The nip between the second-transfer roller 34 and the transfer belt 31 that are in contact with each other is defined as the second-transfer position NT. The second-transfer position NT is supplied with the continuous-form paper P transported from the feed roller 51. The second-transfer roller 34 rotates clockwise in FIG. 1.

Furthermore, a negative voltage is applied to the counter roller 32B from an application unit (not illustrated). Therefore, a potential difference is produced between the counter roller 32B and the second-transfer roller 34. Since the negative voltage is applied to the counter roller 32B, a second-transfer voltage (a positive voltage) of the polarity opposite to the polarity of the toner is indirectly applied to the second-transfer roller 34, which serves as a counter electrode for the counter roller 32B. Thus, a transfer electric field is generated between the counter roller 32B and the second-transfer roller 34, and an electrostatic force acts on the toner images on the transfer belt 31. Consequently, the toner images on the transfer belt 31 are transferred to the continuous-form paper P passing through the second-transfer position NT.

Featured Elements

Figure 2:
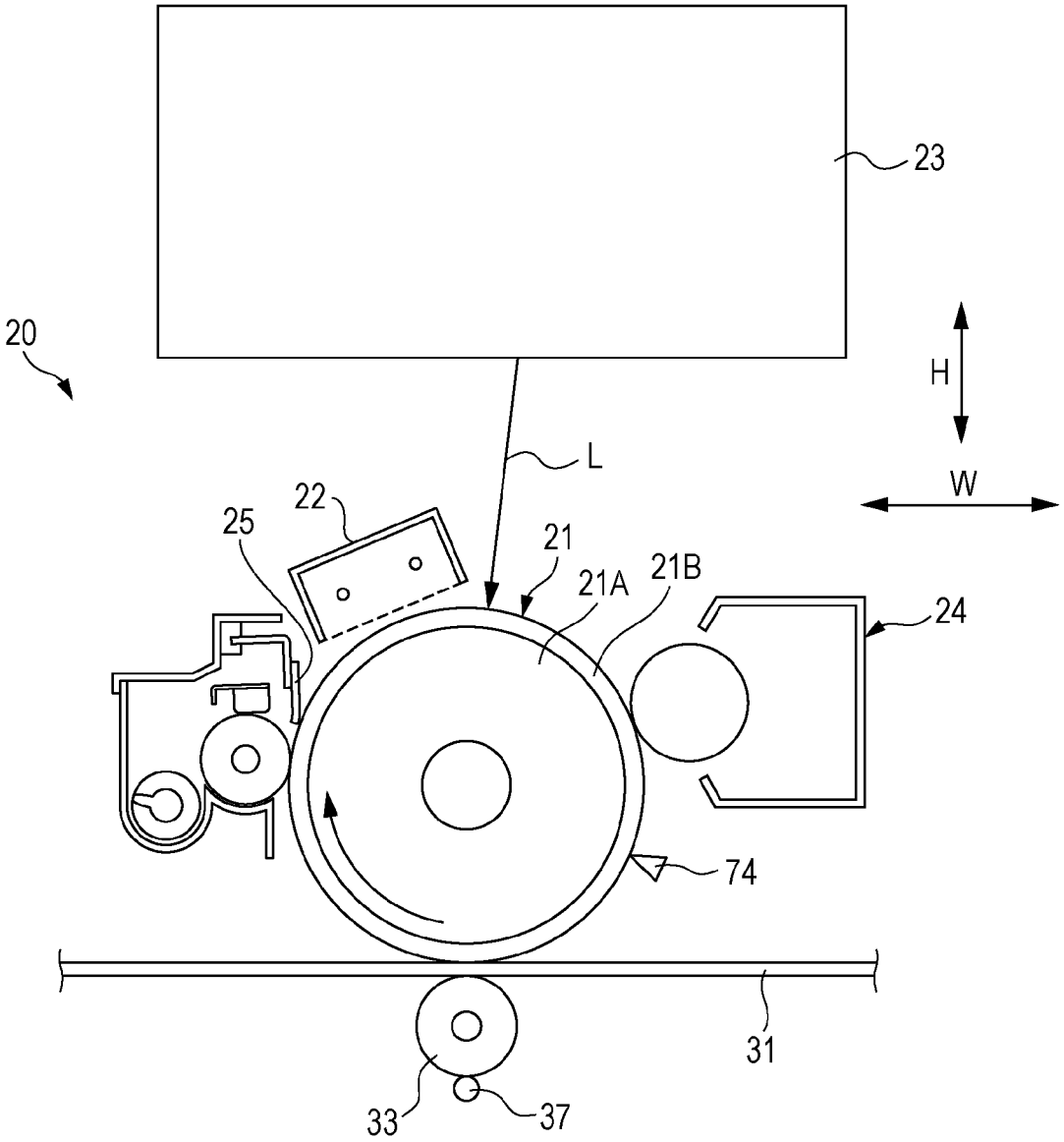
FIG. 2 is a schematic diagram of a toner-image-forming unit according to the exemplary embodiment.

As illustrated in FIG. 2, the photoconductor drum 21 includes a base member 21A (a core member) and a photosensitive layer 21B provided over the outer peripheral surface of the base member 21A.

The photosensitive layer 21B includes, for example, plural layers. Specifically, the photosensitive layer 21B includes, for example, an under layer, a charge generating layer, a charge transporting layer, and a surface layer (an overcoat layer).

The under layer contains, for example, inorganic particles and binding resin. The inorganic particles may be particles of an inorganic material (a conductive metal oxide) such as tin oxide, titanium oxide, zinc oxide, or zirconium oxide.

The charge generating layer contains, for example, a charge generating material and binding resin. The charge generating material may be, for example, an azo pigment such as a bisazo pigment or a trisazo pigment; a condensed-ring aromatic pigment such as a dibromoanthanthrone pigment; a perylene pigment; a pyrrolopyrrole pigment; a phthalocyanine pigment; zinc oxide; trigonal selenium; or the like.

The charge transporting layer contains, for example, a charge transporting material and binding resin. The charge transporting material may be, for example, an electron-transporting compound such as a quinone-based compound (such as p-benzoquinone, chloranil, bromanil, or anthraquinone), a tetracyanoquinodimethane-based compound, a fluorenone compound (such as 2,4,7-trinitrofluorenone), a xanthone-based compound, a benzophenone-based compound, a cyanovinyl-based compound, or an ethylene-based compound; or a positive-hole-transporting compound such as a triarylamine-based compound, a benzidine-based compound, an arylalkane-based compound, an aryl-substituted-ethylene-based compound, a stilbene-based compound, an anthracene-based compound, or a hydrazone-based compound.

The surface layer contains, for example, fluorocarbon particles and binding resin. The fluorocarbon particles may be, for example, polytetrafluoroethylene (PTFE), polychlorotrifluoroethylene, hexafluoropropylene, polyvinyl fluoride, polyvinylidene fluoride, or difluorodichloroethylene.

The under layer, the charge generating layer, the charge transporting layer, and the surface layer are formed over the outer peripheral surface of the base member 21A by immersion coating.

In immersion coating, the base member 21A is oriented with a first axial end thereof facing downward and is immersed in coating liquid containing the material of the layer of interest, whereby the coating liquid is applied to the base member 21A. Then, the base member 21A immersed in the coating liquid is taken out of the coating liquid, and a film of the coating liquid formed on the outer peripheral surface of the base member 21A is dried. The above process is performed for each of the layers described above, whereby the layers are obtained.

If the photosensitive layer 21B includes plural layers, at least the surface layer only needs to be formed by immersion coating.

Figure 3:
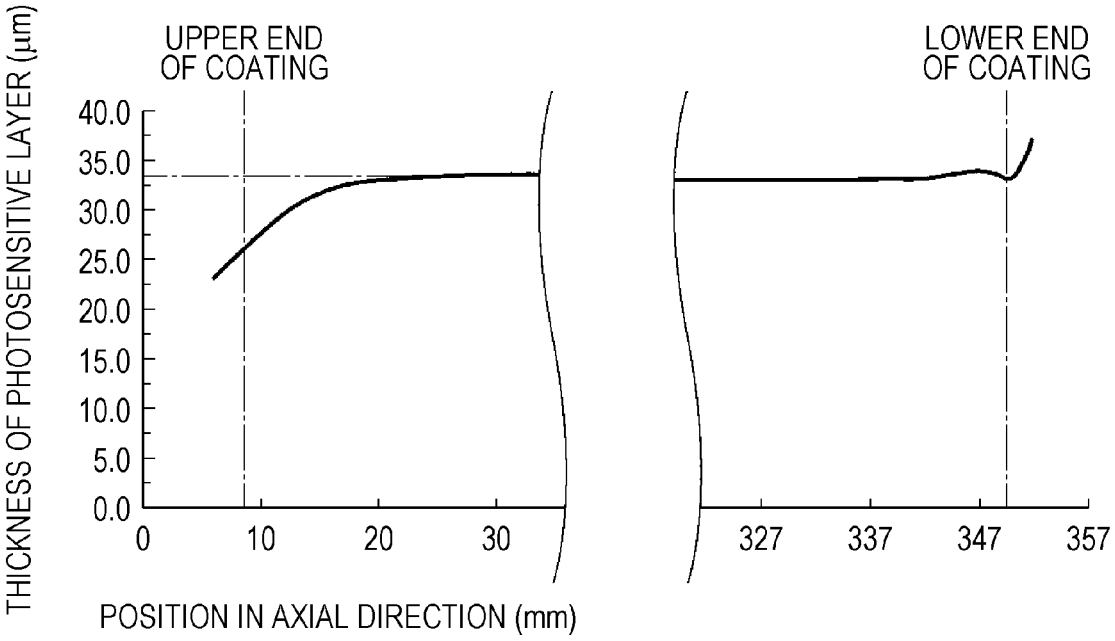
FIG. 3 is a graph illustrating the thickness of a photosensitive layer included in a photoconductor drum according to the exemplary embodiment.

In immersion coating, when the base member 21A is taken out of the coating liquid, the coaling liquid drips from the upper end of the base member 21A (the upper end of the coating). Therefore, as illustrated in FIG. 3, the photosensitive layer 21B becomes thicker at the first end of the photoconductor drum 21 (the lower end of the coating) than at a second end of the photoconductor drum 21 (the upper end of the coating).

When the base member 21A is taken out of the coating liquid, the coating liquid is less likely to drip from the lower end of the base member 21A (the lower end of the coating). However, since the film of the coating liquid becomes thicker at the lower end of the base member 21A (the lower end of the coating) than at the upper end of the base member 21A (the upper end of the coating), the nonuniformity in the thickness of the film of the coating liquid in the circumferential direction of the base member 21A tends to become greater at the lower end of the base member 21A (the lower end of the coating). That is, the thickness of the film at an end 60 of the photoconductor drum 21 tends to vary in the circumferential direction of the photoconductor drum 21.

As described above, the photosensitive layer 21B of the photoconductor drum 21 is thicker at the first axial end than at the second axial end. Hereinafter, the first axial end where the photosensitive layer 21B is thicker is referred to as "thicker end 60," and the second axial end where the photosensitive layer 21B is thinner is referred to as "thinner end 62."

Figure 4:
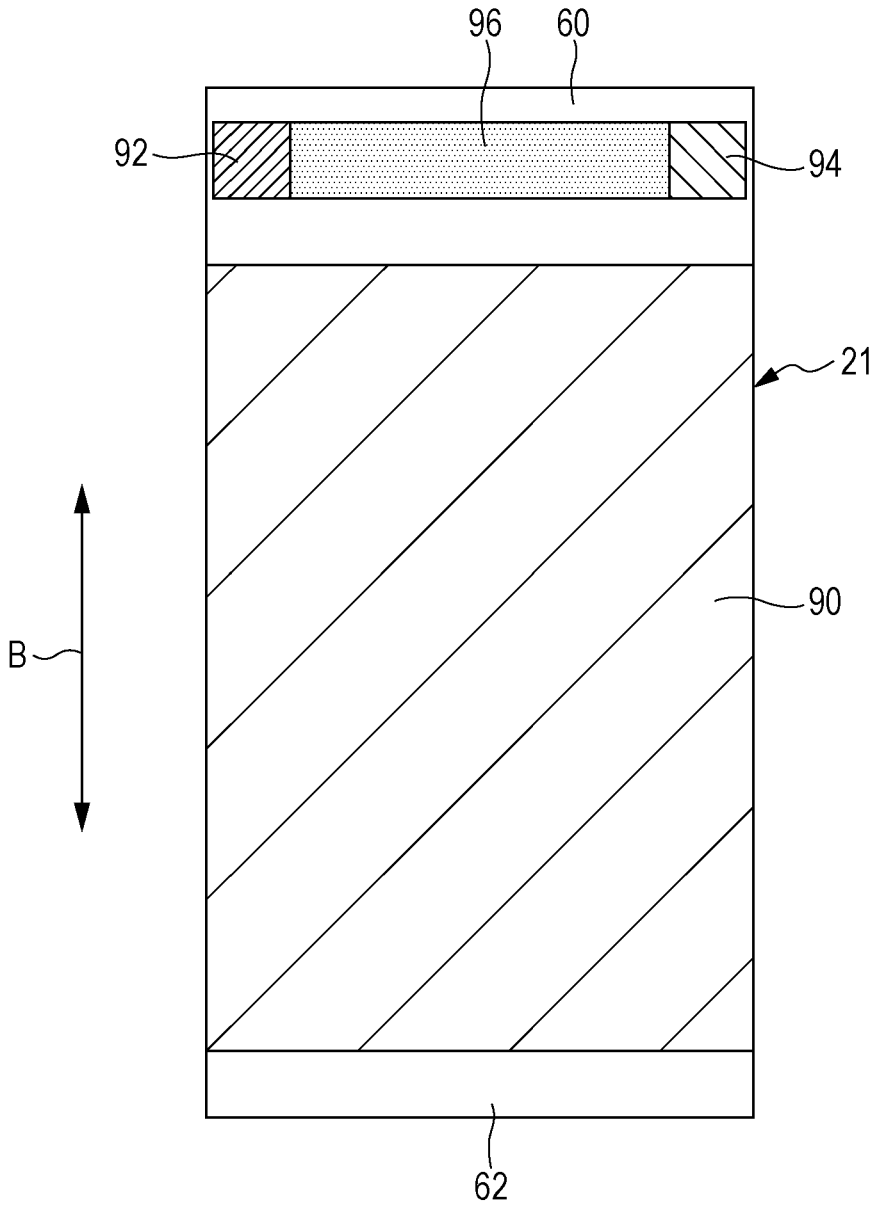
FIG. 4 is a development of the photoconductor drum according to the exemplary embodiment.

FIG. 4 is a development of a representative one of the photoconductor drums 21 and illustrates the outer peripheral surface thereof. In FIG. 4, the axial direction of the photoconductor drum 21 is represented by an arrow B. As illustrated in FIG. 4, the toner image that is formed on the photoconductor drum 21 includes a transfer-object image 90, a patch 92 for color-misregistration detection, a patch 94 for potential control, and a band 96 for protection of the blade 25. The transfer-object image 90 is transferred to each of transfer areas P1 (see FIG. 5) defined on the continuous-form paper P.

Specifically, the patches 92 and 94 and the band 96 are formed at the thicker end 60 of the outer peripheral surface of the photoconductor drum 21. The transfer-object image 90 is formed on a side nearer to the thinner end 62 of the photoconductor drum 21 than the area where the patches 92 and 94 and the band 96 are formed.

The band 96 has a higher image density (a larger amount of toner per unit area) than the patches 92 and 94 and is formed on the photoconductor drum 21 more often than the patches 92 and 94. That is, the number of bands 96 that are formed on the photoconductor drum 21 per unit time is greater than the number of patches 92 or 94 that are formed on the photoconductor drum 21 per unit time. In other words, the amount of toner that is attracted to the photoconductor drum 21 per unit number of revolutions of the photoconductor drum 21 is greater for the bands 96 than for the patches 92 or 94.

In the present embodiment, as illustrated in FIG. 1, a detection sensor 72 (a detecting unit) that detects the patch 92 for color-misregistration detection is provided at a position on the downstream side with respect to the toner-image-forming unit 20K and on the upstream side with respect to the second-transfer position NT in the direction of rotation of the transfer belt 31.

The detection sensor 72 detects the patches 92 included in the respective toner images on the transfer belt 31, whereby any misregistration of the toner images in the respective colors on the transfer belt 31 is detected. On the basis of the result of the detection, the controller 70 controls, as conditions for image formation, the positions of images to be formed on the respective photoconductor drums 21.

Referring now to FIG. 2, a detection sensor 74 (another detecting unit) that detects the patch 94 for potential control is provided to each of the photoconductor drums 21 at a position on the downstream side with respect to the developing device 24 and on the upstream side with respect to the first-transfer position T in the direction of rotation of the photoconductor drum 21.

The detection sensor 74 detects the density of the patch 94. Then, the controller 70 controls the levels of charging potential, exposure potential, and development potential (conditions for image formation) such that the detected density is adjusted to a predetermined target density.

Note that the patch 94 for potential control is formed at the first axial end of the photoconductor drum 21, and the levels of charging potential, exposure potential, and development potential are controlled on the premise that the image density at the first axial end of the photoconductor drum 21 is substantially the same as the image density in an axially central part of the photoconductor drum 21 and the image density at the second axial end of the photoconductor drum 21.

Toner particles forming the band 96 for protection of the blade 25 are fed to a position between the photoconductor drum 21 and the blade 25 with the rotation of the photoconductor drum 21. Therefore, the friction between the blade 25 and the photoconductor drum 21 is reduced. Thus, the blade 25 is protected.

Figure 5:
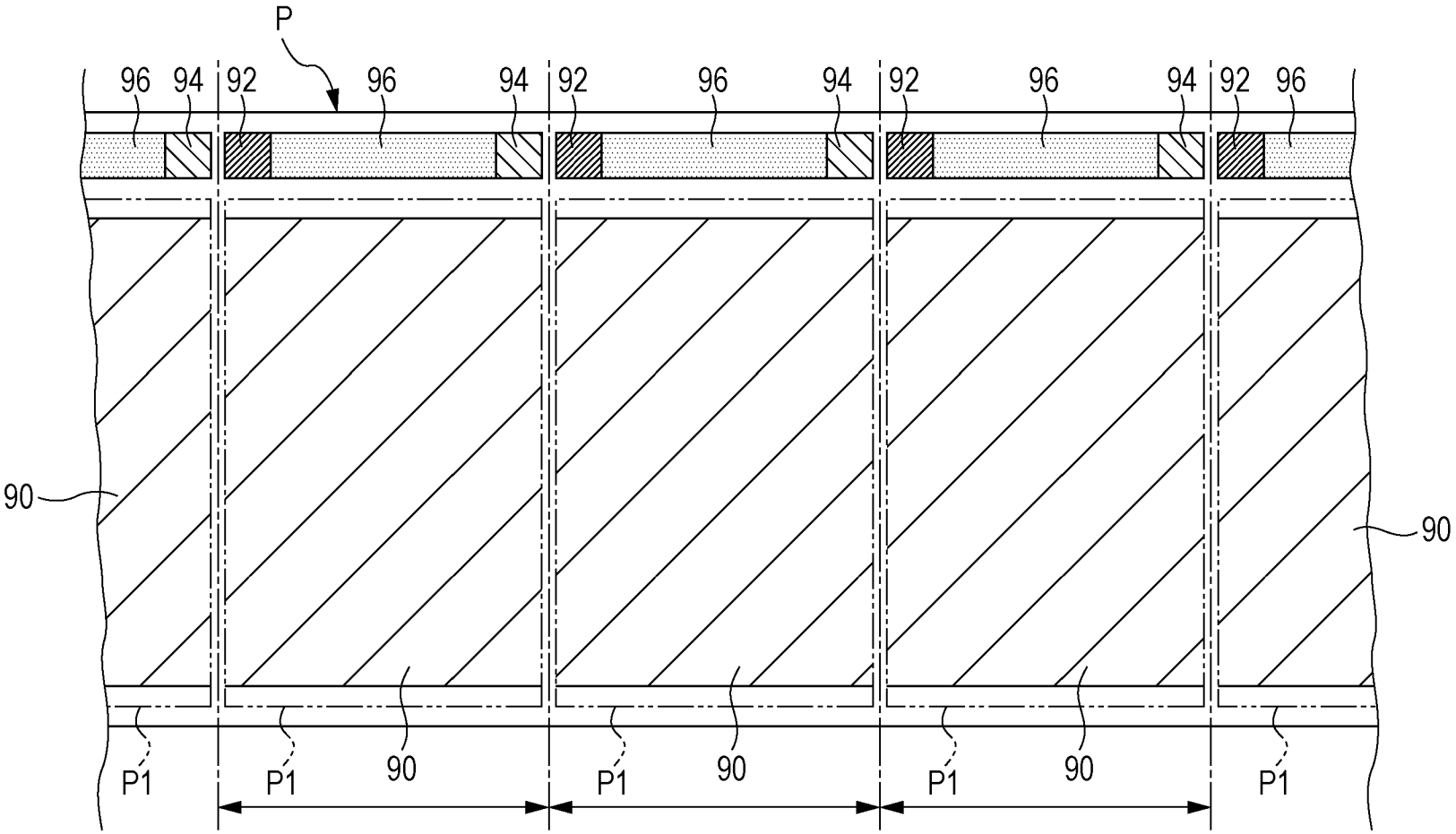
FIG. 5 is a schematic diagram illustrating transfer-object images, patches for color-misregistration detection, and patches for potential control that are formed on continuous-form paper in the exemplary embodiment.

Note that the transfer-object image 90 that has been transferred from the photoconductor drum 21 to the transfer belt 31 is transferred to each of the transfer areas P1 that are defined on the continuous-form paper P, as illustrated in FIG. 5. That is, the transfer-object image 90 serves as an exemplary first image that is transferred to each of the transfer areas P1 of the continuous-form paper P.

The patches 92 and 94 and the band 96 transferred from the photoconductor drum 21 to the transfer belt 31 are further transferred to a first widthwise end (an end in a direction orthogonal to the longitudinal direction) of the continuous-form paper P. That is, the patches 92 and 94 and the band 96 are transferred to neither a position between adjacent ones of the transfer areas P1 that are side by side in the longitudinal direction of the continuous-form paper P nor a position in any of the transfer areas P1.

Thus, the patches 92 and 94 and the band 96 serve as exemplary second images that are transferred to neither the position between adjacent ones of the transfer areas P1 that are side by side in the longitudinal direction of the continuous-form paper P nor the position in any of the transfer areas P1.

Functions of Exemplary Embodiment

Functions of the present exemplary embodiment will now be described in comparison with functions of a comparative example.

In the comparative example, the patches 92 and 94 and the band 96 are formed only at the thinner end 62 of the outer peripheral surface of the photoconductor drum 21.

Therefore, the attraction of toner particles, the transfer of toner particles, and the removal of residual toner particles are performed repeatedly at the thinner end 62 of the photoconductor drum 21, and the photoconductor drum 21 is subjected to a stress (load) at the thinner end 62. Consequently, the rate of abrasion at the thinner end 62 of the photoconductor drum 21 (for example, the amount of abrasion per unit number of revolutions of the photoconductor drum 21) becomes high, and the life of the photoconductor drum 21 is shortened.

In contrast, according to the present exemplary embodiment, the patches 92 and 94 and the band 96 are formed at the thicker end 60 of the outer peripheral surface of the photoconductor drum 21.

Therefore, the rate of abrasion at the thicker end 60 of the photoconductor drum 21 (the amount of abrasion per unit number of revolutions of the photoconductor drum 21) becomes high.

Modifications

Figure 6:
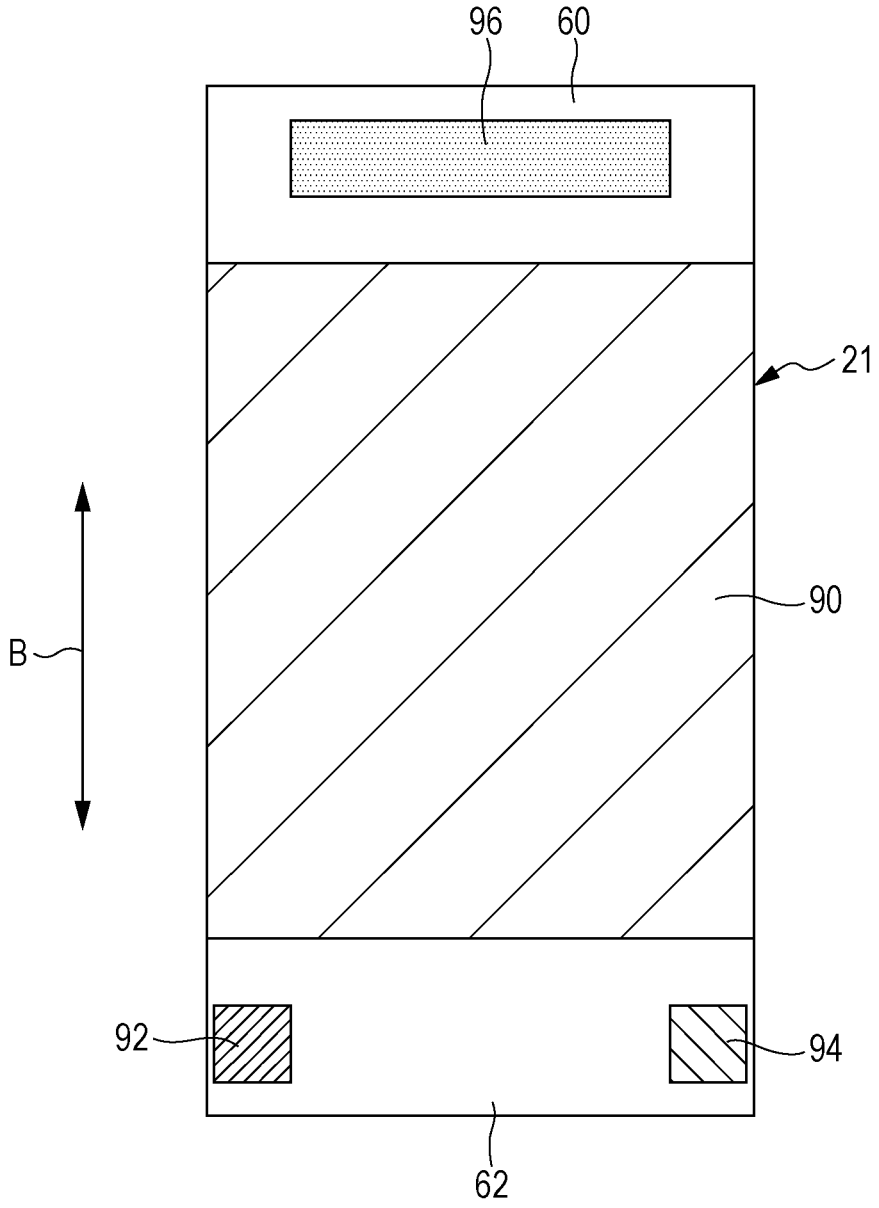
FIG. 6 is a development of a photoconductor drum according to a modification of the exemplary embodiment.

While the above exemplary embodiment concerns a case where the patches 92 and 94 and the band 96 are formed at the thicker end 60 of the outer peripheral surface of the photoconductor drum 21, the present invention is not limited to such a case. For example, as illustrated in FIG. 6, while the band 96 is formed at the thicker end 60 of the outer peripheral surface of the photoconductor drum 21, the patches 92 and 94 may be formed at the thinner end 62 of the outer peripheral surface of the photoconductor drum 21.

In such a modification, the band 96 is transferred to neither the position between adjacent ones of the transfer areas P1 that are side by side in the longitudinal direction of the continuous-form paper P nor the position in any of the transfer areas P1, and the band 96 serves as an exemplary second image that is formed in a more number per unit time than the patch 92 or 94. Note that the second image according to the modification is not used in the operation of controlling the conditions for image formation. The phrase "not used in the operation of controlling the conditions for image formation" does not imply that no operation of controlling (adjusting) the conditions for image formation is performed as a result of formation of the second image, but implies that the density of the second image is not detected by the detection sensor 72 or 74 (an exemplary detecting unit) or that the density of the second image is detected by the detection sensor 72 or 74 but is not used in the operation of controlling the conditions for image formation.

The patches 92 and 94 each serve as an exemplary third image that is transferred to neither the position between adjacent ones of the transfer areas P1 that are side by side in the longitudinal direction of the continuous-form paper P nor the position in any of the transfer areas P1. Note that the third image is detected by the detection sensor 72 or 74 (a detecting unit) and is used in the operation of controlling the conditions for image formation.

As described above, according to the modification, the band 96, which is formed in a relatively large number per unit time on the photoconductor drum 21, is formed at the thicker end 60 of the outer peripheral surface of the photoconductor drum 21.

Furthermore, according to the modification, the patch 94 and the band 96 are formed at different positions in the axial direction of the photoconductor drum 21.

In a case (an example comparative to the modification) where the patch 94 and the band 96 are formed at the same position in the axial direction of the photoconductor drum 21, the attraction of toner particles, the transfer of toner particles, and the removal of residual toner particles are performed repeatedly at that position, and the photoconductor drum 21 is subjected to a stress (load) at that position. Hence, the abrasion progresses at that position, lowering the sensitivity of the photoconductor drum 21 or raising the potential of the photoconductor drum 21.

Consequently, the result of detection of the patch 94 by the detection sensor 74 may deviate from the characteristics, such as sensitivity and potential, in the axially central part of the photoconductor drum 21. In such an event, even if conditions such as the levels of charging potential, exposure potential, and development potential are controlled by the controller 70 on the basis of the result of detection of the patch 94 by the detection sensor 74, the conditions are not controlled appropriately.

Hence, according to the above modification, the patch 94 and the band 96 are formed at different positions in the axial direction of the photoconductor drum 21.

Other Modifications

Figure 7:
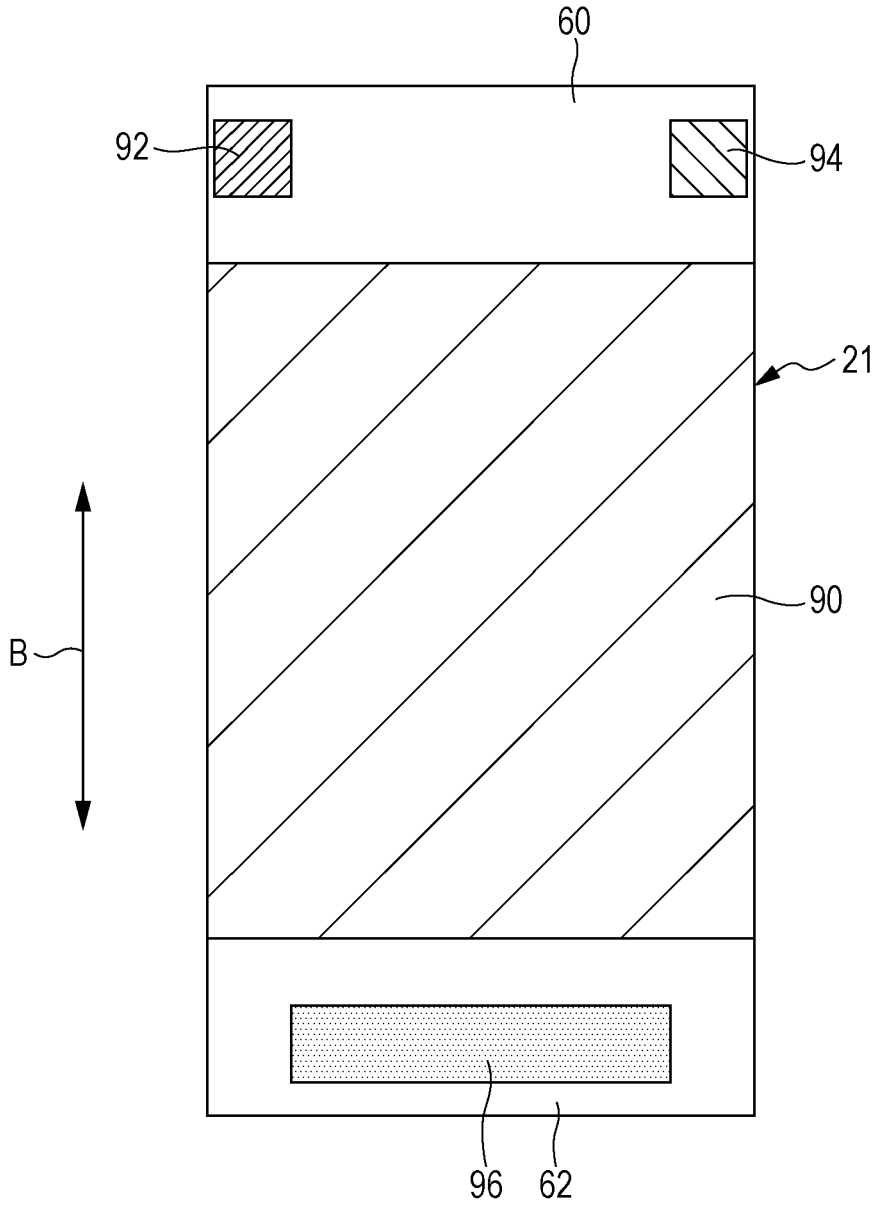
FIG. 7 is a development of a photoconductor drum according to another modification of the exemplary embodiment.

While the above exemplary embodiment concerns a case where the patches 92 and 94 and the band 96 are formed at the thicker end 60 of the outer peripheral surface of the photoconductor drum 21, the present invention is not limited to such a case. For example, as illustrated in FIG. 7, while the patches 92 and 94 are formed at the thicker end 60 of the outer peripheral surface of the photoconductor drum 21, the band 96 may be formed at the thinner end 62 of the outer peripheral surface of the photoconductor drum 21.

Furthermore, while the above exemplary embodiment concerns a case where the patch 92 for color-misregistration detection and the patch 94 for potential control are employed as the second images (or the third images in the modification illustrated in FIG. 6), the present invention is not limited to such a case. For example, the second images (or the third images in the modification illustrated in FIG. 6) may each be a gradation path for adjustment of the gradation of each of the colors.

Furthermore, while the above exemplary embodiment concerns a case where the band 96 for protection of the blade 25 is employed as the second image, the present invention is not limited to such a case. For example, the second image may be a band for consumption of deteriorated developer (toner particles).

Furthermore, while the above exemplary embodiment concerns a case where the patches 92 and 94 and the band 96 are transferred to the continuous-form paper P, the present invention is not limited to such a case. For example, the second and third images may be retained on the transfer belt 31 and be removed by a cleaning device or the like, instead of being transferred from the transfer belt 31 to the continuous-form paper P.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photosensitive member that includes a photosensitive layer, the photosensitive layer being thicker at a first axial end of the photosensitive member than at a second axial end of the photosensitive member; and a forming unit configured to form a first image and a second image on the photosensitive member, wherein the image forming apparatus is configured to transfer the first image to each of transfer areas defined on continuous-form paper, and wherein the image forming apparatus is configured to transfer the second image to an axial end of the continuous-form paper corresponding to the first axial end of the photosensitive member, but not to a position between adjacent ones of the transfer areas that are side by side in a longitudinal direction of the continuous-form paper or to a position in any of the transfer areas, wherein the second image comprises a blade protection band.

2. The image forming apparatus according to claim 1, wherein the forming unit is configured to form:

a third image at the second axial end; and the second image at the first axial end, wherein the image forming apparatus is configured to transfer the third image to a position other than the position between adjacent ones of the transfer areas that are side by side in a longitudinal direction of the continuous form paper and other than the position in any of the transfer areas, wherein the forming unit is configured to form the second image such that the second image has a larger amount of toner per unit area than the third image.

3. The image forming apparatus according to claim 1, wherein the forming unit is configured to form:

a third image at the first axial end; and the second image at the first axial end, wherein the image forming apparatus is configured to transfer the third image to a position other than the position between adjacent ones of the transfer areas that are side by side in a longitudinal direction of the continuous form paper and other than the position in any of the transfer areas, wherein the forming unit is configured to form a plurality of second images and a plurality of third images, and wherein the forming unit is configured to form more second images than third images per unit time.

4. The image forming apparatus according to claim 1, wherein the image forming apparatus is configured to, in response to a determination that the photosensitive layer is thicker at the first axial end than at the second axial end, transfer the second image to the axial end of the continuous-form paper corresponding to the first axial end of the photosensitive member, but not to any positions between adjacent ones of the transfer areas that are side by side in the longitudinal direction of the continuous-form paper and not to any positions in any of the transfer areas.

5. The image forming apparatus according to claim 1, wherein the image forming apparatus is configured to transfer the first image to the continuous-form paper at a position more toward a center in an axial direction of the continuous-form paper than the transferred second image, wherein a first side of the transferred first image is a side closest to the transferred second image, and wherein the image forming apparatus is configured to never transfer any pattern images to any positions on a second side of the transferred first image opposite to the first side in the axial direction of the continuous-form paper.

6. An image forming apparatus comprising:

a photosensitive member that includes a photosensitive layer, the photosensitive layer being thicker at a first axial end of the photosensitive member than at a second axial end of the photosensitive member; and a forming unit configured to form a first image and a second image on the photosensitive member, wherein the image forming apparatus is configured to transfer the first image to each of transfer areas defined on continuous-form paper, and wherein the image forming apparatus is configured to, in response to the photosensitive layer being thicker at the first axial end than at the second axial end, transfer the second image to an axial end of the continuous-form paper corresponding to the first axial end of the photosensitive member, but not to a position between adjacent ones of the transfer areas that are side by side in a longitudinal direction of the continuous-form paper or to a position in any of the transfer areas.

7. An image forming apparatus comprising:

a photosensitive member that includes a photosensitive layer, the photosensitive layer being thicker at a first axial end of the photosensitive member than at a second axial end of the photosensitive member; and a forming unit comprising:

a charger;

a light source; and a developer, wherein the forming unit is configured to form a first image and a second image on the photosensitive member, wherein the image forming apparatus is configured to transfer the first image to each of transfer areas defined on continuous-form paper, and wherein the image forming apparatus is configured to, in response to a determination that the photosensitive layer is thicker at the first axial end than at the second axial end, transfer the second image to an axial end of the continuous-form paper corresponding to the first axial end of the photosensitive member, but not to a position between adjacent ones of the transfer areas that are side by side in a longitudinal direction of the continuous-form paper or to a position in any of the transfer areas.

* * * * *